US007579778B2

(12) United States Patent
Vaszari et al.

(10) Patent No.: US 7,579,778 B2
(45) Date of Patent: Aug. 25, 2009

(54) TRAVELING-WAVE TUBE WITH INTEGRATED ION TRAP POWER SUPPLY

(75) Inventors: John P. Vaszari, Rancho Palos Verdes, CA (US); Ronald G. Brownell, Redondo Beach, CA (US)

(73) Assignee: L-3 Communications Electron Technologies, Inc., Torrance, CA (US)

( * ) Notice: Subject to any disclaimer, the term of this patent is extended or adjusted under 35 U.S.C. 154(b) by 242 days.

(21) Appl. No.: 11/484,872

(22) Filed: Jul. 11, 2006

(65) Prior Publication Data

US 2008/0012657 A1 Jan. 17, 2008

(51) Int. Cl.
*H01J 23/11* (2006.01)

(52) U.S. Cl. ..... 315/3.5; 315/5.38

(58) Field of Classification Search ..... 315/5.38, 315/3.5, 39.3

See application file for complete search history.

(56) References Cited

U.S. PATENT DOCUMENTS

| | | | | |
|---|---|---|---|---|
| 2,956,199 | A * | 10/1960 | Briskin | 315/3.5 |
| 3,723,798 | A * | 3/1973 | O'Brien | 315/3.5 |
| 4,631,447 | A | 12/1986 | Friedman et al. | 315/5 |
| 5,500,621 | A * | 3/1996 | Katz et al. | 330/43 |
| 5,568,014 | A | 10/1996 | Aoki et al. | 315/3.5 |
| 6,111,358 | A | 8/2000 | Cardwell et al. | 315/3.5 |
| 6,262,536 | B1 | 7/2001 | Symons | 315/3 |
| 6,356,023 | B1 | 3/2002 | Kosmahl | 315/3.5 |
| 6,777,876 | B2 | 8/2004 | Kobayashi et al. | 315/3.5 |
| 6,838,829 | B2 | 1/2005 | Ives | 315/5.38 |
| 6,844,547 | B2 | 1/2005 | Syka | 250/292 |
| 6,909,235 | B2 | 6/2005 | Wolkstein et al. | 315/3.5 |
| 2006/0067965 | A1 * | 3/2006 | Chandra et al. | 424/405 |

* cited by examiner

*Primary Examiner*—Benny T. Lee
(74) *Attorney, Agent, or Firm*—Proskauer Rose, LLP

(57) ABSTRACT

A traveling-wave tube system and a method for protecting a cathode of a traveling-wave tube system. The system has an electron gun and a power supply that applies an electric potential between a cathode and an anode of the electron gun to generate a beam of electrons. The beam of electrons passes through a passage of a slow-wave structure. A collector electrode collects electrons from the beam of electrons generating a flow of current that flows through an ion trap power supply circuit to generate a DC voltage that is applied to the anode to repel positive ions generated.

11 Claims, 2 Drawing Sheets

TRAVELING-WAVE TUBE WITH INTEGRATED ION TRAP POWER SUPPLY

FIELD OF THE INVENTION

The invention relates to traveling-wave tube systems and more particularly to systems and methods for protecting the system from ions generated during operation.

BACKGROUND OF THE INVENTION

Traveling-wave tubes are capable of amplifying and generating microwave signals over a considerable frequency range (e.g., 1-90 GHz) with relatively high output powers (e.g., >10 megawatts), relatively large signal gains (e.g., 60 dB), and over relatively broad bandwidths (e.g., >10%).

In a traveling-wave tube, an electron gun generates a beam of electrons that are directed through a slow-wave structure and collected by a collector. The electron gun generates the beam of electrons by creating an electrical potential between a cathode and an anode. Electrons emitted from the cathode are accelerated towards the anode by the electrical potential between the anode and cathode. The slow-wave structure generally comprises either a helical conductor or a coupled cavity circuit with signal input and output ports located at opposite ends of the structure. The electron beam is directed into an opening of the slow-wave structure, through the slow-wave structure, and out another opening in the slow-wave structure. A beam-focusing structure surrounding the slow-wave structure creates an axial magnetic field that contains the electron beam within the slow-wave structure.

A microwave signal applied to one of the ports propagates along the slow-wave structure to the other port at a projected axial velocity that is considerably less than the free space speed of light. With the velocity of the electron beam adjusted to be similar to the projected axial velocity of the microwave signal propagating along the slow-wave structure, the fields of the microwave signal and electron beam interact with one another so as to transfer energy from the electron beam to the microwave signal, thereby amplifying the microwave signal.

A traveling-wave tube may be used as an amplifier by coupling a microwave signal to the signal input port of the slow-wave structure. The microwave signal propagates towards the signal output port in the same direction as the electron beam and becomes amplified by extracting energy from the electron beam. As a result of this energy exchange, the electron beam loses energy which reduces the velocity of the electron beam.

Traveling-wave tubes sometimes also include a second anode located between the cathode and the traveling-wave tube and that is used as an ion trap. During operation, the electron beam ionizes residual gas molecules in the traveling-wave tube. The ions produced drift towards the electron gun and are accelerated towards the cathode where they contaminate the cathode and interfere with operation of the system. The ion trap is used to repel the ions generated to prevent the ions from bombarding the cathode, thus preventing premature aging of the cathode and/or reduction in system performance.

One problem with some prior art traveling-wave tube systems is that they do not include an ion trap. Another problem with some prior art traveling-wave tube systems is that they do not have a power supply suitable to operate the ion trap.

A need therefore exists for systems and methods for providing traveling-wave tubes with an ion trap and suitable source of power to operate the ion trap.

SUMMARY OF THE INVENTION

Ion traps are particularly important in traveling-wave tube systems that operate in continuous wave mode in which the electron gun generates the beam of electrons continuously, substantially continuously, or at a rate of operation that is sufficient such that ions generated do not adequately disperse during interruptions of electron beam current. Some traveling-wave tube systems do not currently incorporate an ion trap or the required power supply. Retrofitting such systems with a dedicated ion trap and/or power supply required to operate the ion trap is not practical because it requires, for example, modifying the existing high voltage power supply used to operate the electron gun.

Principles of the invention provide the benefit of an ion trap to existing traveling-wave tube systems without changing the design (e.g., form, fit and function) of the traveling-wave tube. Further, the collector provides the required voltage and flow of current to an ion circuit power supply to operate the ion trap. The flow of current is provided by the electrons collected from the beam of electrons impinging on the collector electrode during operation. The ion trap power supply circuit generates a positive anode voltage to enable the anode to repel ions generated.

The invention, in some embodiments, features a traveling-wave tube system. The system includes an electron gun having a cathode and an anode for generating a beam of electrons. The system also includes a power supply for applying an electric potential between the cathode and the anode. The system also includes a slow-wave structure having a passage through which the beam of electrons passes and a collector having a collector electrode for collecting electrons from the beam of electrons which generates a flow of current. The system also includes an ion trap power supply circuit electrically coupled to the collector electrode to generate a DC voltage from current flowing through the ion trap power supply circuit and for applying the DC voltage to the anode to repel positive ions generated.

In some embodiments, current flows through the ion trap power supply circuit when the electron gun is generating the beam of electrons. In some embodiments, the anode is located between the electron gun cathode and an opening to the passage in the slow-wave structure. In some embodiments, the ion trap power supply circuit is an oscillator circuit. In some embodiments, the system includes a vacuum pump to remove the ions. The anode can prevent ions from traveling to the cathode when, for example, a positive DC voltage is applied to the anode.

The invention, in one aspect, relates to a method for protecting a cathode of a traveling-wave tube system. The method involves applying an electric potential between a cathode and an anode to generate a beam of electrons. The method also involves collecting electrons from the beam of electrons with a collector electrode after passing through a passage of a slow-wave structure thereby generating a flow of current. The method also involves directing the flow of current from the collector electrode through an ion trap power supply circuit to generate a DC voltage and applying the DC voltage to the anode to repel positive ions generated.

The invention, in another aspect, features a traveling-wave tube system. The system includes an electron gun for generating a beam of electrons and an ion trap having an anode. The system also includes a collector having a collector electrode for collecting electrons from the beam of electrons. The system also includes an ion trap power supply circuit electrically coupled to the collector electrode to generate a DC voltage and for applying the DC voltage to the anode to repel positive ions generated.

The traveling-wave tube system can include a power supply for applying an electric potential between a cathode of the electron gun and the anode to generate the beam of electrons. The system can include a slow-wave structure having a passage, located between the electron gun and the collector through which the beam of electrons passes. In some embodiments, current flows from the collector and through the ion trap power supply circuit to generate the DC voltage. In some embodiments, the ion trap anode in combination with the cathode generates the beam of electrons.

The invention, in another aspect, features a traveling-wave tube system. The system includes an electron gun comprising a cathode and an anode for generating a beam of electrons. The system also includes a power supply for applying an electric potential between the cathode and the anode. The system also includes a slow-wave structure having a passage through which the beam of electrons passes and a collector having a collector electrode for collecting electrons from the beam of electrons. The system also includes a means for generating a DC voltage from current flowing from the collector electrode and for applying the DC voltage to the anode to prevent ions generated from traveling to the cathode.

The foregoing and other objects, aspects, features, and advantages of the invention will become more apparent from the following description and from the claims.

BRIEF DESCRIPTION OF THE DRAWINGS

The foregoing and other objects, features and advantages of the invention, as well as the invention itself, will be more fully understood from the following illustrative description, when read together with the accompanying drawings which are not necessarily to scale.

DETAILED DESCRIPTION OF ILLUSTRATIVE EMBODIMENTS

Figure 1:
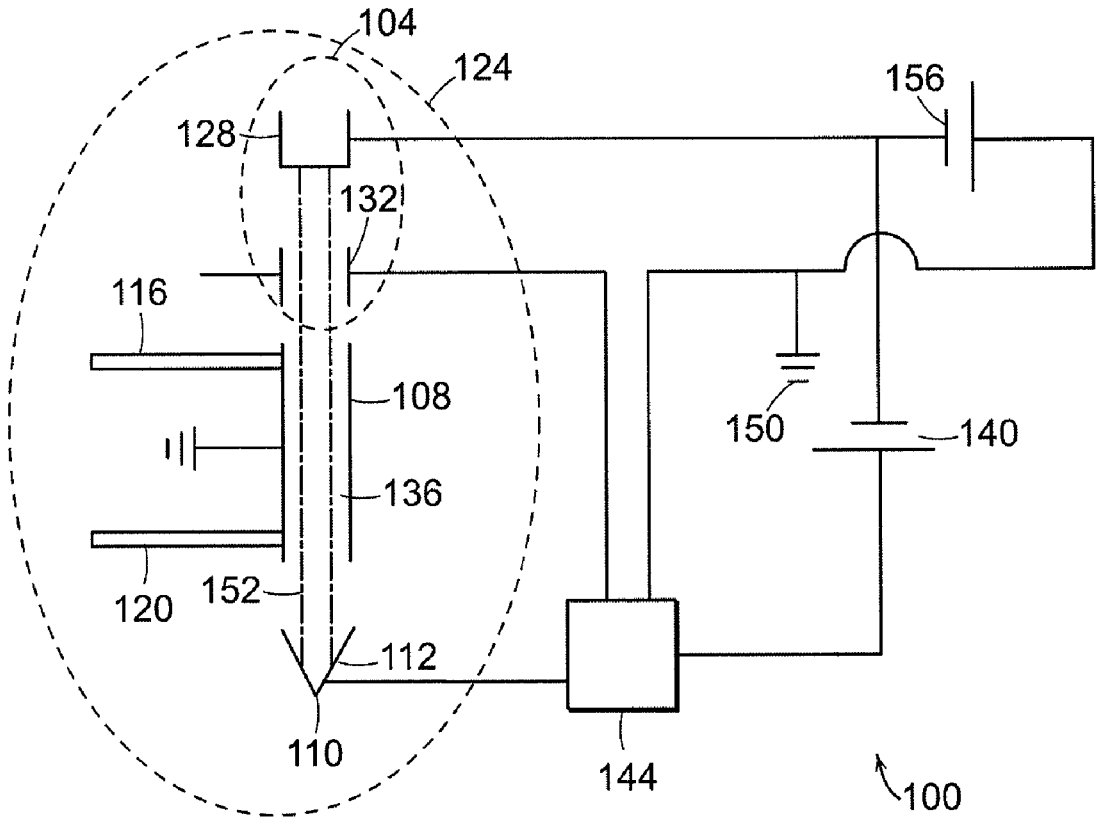
FIG. 1 is a schematic illustration of a traveling-wave tube system, according to an illustrative embodiment of the invention.

FIG. 1 is a schematic illustration of a traveling-wave tube system 100 that embodies principles of the invention. The system 100 includes a traveling-wave tube 124, an electron gun 104, a slow-wave structure 108 and a collector 110 having at least one collector electrode 112. The slow-wave structure 108 includes a signal input port 116 and a signal output port 120. Typically, a housing (not shown) encloses and protects the components of the traveling-wave tube 124.

The electron gun 104 includes a cathode 128 and an anode 132. In operation, an electric potential is applied between the cathode 128 and the anode 132. The cathode 128 generates and emits a beam of electrons 152 in response to the applied electric potential. In one embodiment, a potential of greater than several thousand volts is generally applied between the cathode 128 and the anode 132 to generate the beam of electrons. To generate the beam of electrons, the cathode 128 is set at a large negative voltage relative to the anode 132. In some embodiments, a heater (not shown) is used to heat the cathode 128 to initiate and/or maintain a flow of electrons emitted from the cathode 128 to produce the beam of electrons.

The slow-wave structure 108 is located adjacent the electron gun 104 such that the electron beam passes through a passage 136 in the slow-wave structure 108. The slow-wave structure 108 generally includes a helical structure or a coupled cavity circuit. In operation, a microwave signal is introduced to the slow-wave structure via the input port 116 of the slow-wave structure 108. The microwave signal propagates along the slow-wave structure 108 at an axial velocity that is substantially less than the speed of light. The axial velocity is a function of the electrical and geometrical properties of the slow-wave structure 108. The ratio of the axial velocity to the free-space velocity is often referred to as the velocity factor of the slow-wave structure 108.

The velocity factor of the slow-wave structure 108 and the electrical potential between the cathode 128 and the anode 132 are chosen so that the electric fields of the microwave signal interact with the beam of electrons in the slow-wave structure 108. The interaction between the microwave signal and the beam of electrons results in velocity modulation of the beam of electrons and energy is transferred from the beam of electrons to the microwave signal, thereby amplifying the microwave signal while slowing the velocity of the electrons in the beam of electrons. The amplified microwave signal exits the output port 120 of the slow-wave structure 108. The electrons in the beam of electrons that pass through the passage 136 of the slow-wave structure 108 are collected by the collector electrode 112 of the collector 110. The collector 110 is maintained at a negative DC voltage, for example, −11 kV in one embodiment. A collector high voltage power supply 140 provides the DC voltage to the collector 110 via an ion trap power supply 144. Alternative DC voltage magnitudes can be applied to the collector 110.

By way of example, the microwave signal initially travels close to the speed of light and must be slowed down to the speed of the beam of electrons which travel at about 10% to about 50% of the speed of light. In a slow-wave structure 108 incorporating a helix structure, the microwave signal travels along the generally circular/spiral path of the helix. The beam of electrons travels a distance of about one pitch of the helical structure which is a smaller distance than one revolution of the circular path of the helical structure. In this manner, the speed of the microwave signal is reduced to approximately the speed of the beam of electrons so energy can be transferred from the beam of electrons to the microwave signal while they interact with each other.

A coupled cavity circuit (or structure) may, alternatively, be used in the slow-wave structure 108. In a coupled cavity circuit, the microwave signal travels along the inner surfaces of the cavities of the circuit while the beam of electrons passes through openings between adjacent cavities. The microwave signal travels over a larger distance than the beam of electrons, thereby slowing the microwave signal relative to the beam of electrons.

In some embodiments, the traveling-wave tube system 100 includes a plurality of collector electrodes, each at a different electric potential relative to the body (e.g., housing) of the traveling-wave tube 124 to collect electrons of different electric potential levels. In some embodiments, the traveling-wave tube system 100 incorporates a vacuum ion pump to collect ions generated.

The traveling-wave tube system 100 also includes a high voltage power supply 156 that provides the electrical potential between the cathode 128 and the anode 132 of the traveling-wave tube 124. The high voltage power supply 156 maintains the cathode 128 at a large, negative electrical potential (e.g., about −20 kV). In some embodiments, the high voltage power supply 156 maintains the cathode 128 at an electric potential between about −10 kV and about −50 kV.

A high voltage potential (e.g., −20 kV) is applied to the cathode 128 by the power supply 156 and a low voltage (e.g., 0 V or ground) is applied to the anode 132 (which is electrically isolated from the cathode 128). The potential difference between the cathode 128 and the anode 132 generates the beam of electrons 152 that flows from the cathode 128, through the slow-wave structure 108, and terminates at the collector electrode 112, as described herein previously. The electrons from the beam of electrons 152 that terminate at the collector electrode 112 generate a flow of current that is provided by the collector 110 to the ion trap power supply 144.

The flow of the collector current through the ion trap power supply 144 generates an electrical voltage of about +200V on the isolated anode 132 which provides the ion trap that prevents positive ions from traveling to the cathode 128. The +200 volt electrical potential applied to the anode 132 repels ions generated in the slow-wave structure 108 from the anode 132. The ions are positively charged molecules formed by the interaction of the beam of electrons 152 with residual gas molecules located in the slow-wave structure 108. Because the anode 132 is maintained at a positive voltage (e.g., +200 volts in one embodiment) and the ions are positively charged, the anode 132 acts as an electrical barrier that prevents the ions from traveling towards the cathode 128 (which has a large negative electrical voltage potential relative to the positively charged ions).

In some embodiments, different components of the system may be incorporated together in, for example, a single housing or enclosure. For example, the collector high voltage power supply 140 and the high voltage power supply 156 may be incorporated into a single electronics enclosure.

Figure 2:
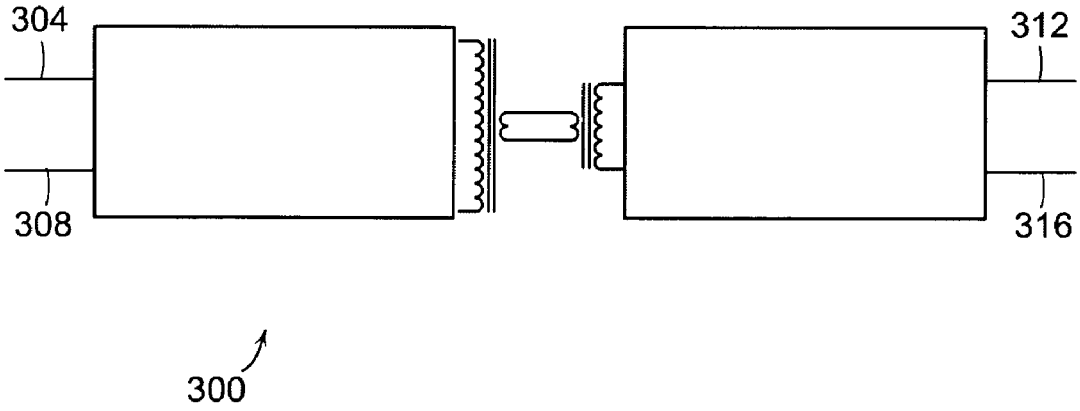
FIG. 2 is a circuit schematic of an ion trap power supply circuit, according to an illustrative embodiment of the invention.

FIG. 2 is a schematic illustration of one example of an ion trap power supply circuit 300 for use in a traveling-wave tube system, for example, the traveling-wave tube system of FIG. 1. The ion trap power supply circuit 300 has a collector high voltage power supply connection 304 that is connected to, for example, the collector high voltage power supply 140 of FIG. 1. The ion trap power supply circuit 300 also has a collector connection 308 that is connected to, for example, the collector electrode 112 of FIG. 1. The ion trap power supply circuit 300 also has an anode connection 312 that is connected to, for example, the anode 132 of FIG. 1. The ion trap power supply circuit 300 also has a connection 316 that is connected to, for example, an electrical ground 150 of the high voltage power supply 156 of FIG. 1.

The current produced by the electrons that impact the collector electrode 112 flows through the ion trap power supply circuit 300. The DC voltage on the collector electrode 112 is provided by the high voltage power supply 140 (e.g., −11 kV applied by the collector high voltage power supply 140 via the ion trap power supply 144). In some embodiments of the invention, alternative voltage levels can be applied to the anode 132 if the voltage is sufficient to repel the positive ions generated. For example, in some embodiments, a voltage level between about 50 volts and about 400 volts can be applied to the anode 132.

In one embodiment of the invention, the current of the collector electrode 112 flows through zener diodes (not shown) in the ion trap power supply circuit via a collector connection (e.g., the collector connection 308 of FIG. 2). The zener diodes provide a voltage to drive a push-pull Ruyer oscillator. The output of the Ruyer oscillator drives a step-down transformer that is coupled to a second transformer via link windings of the transformers to provide a high voltage standoff. The output of the second transformer is rectified by a voltage multiplier and then regulated by a zener diode that provides the positive voltage applied to the anode 132 via an anode connection (e.g., anode connection 312 of FIG. 2). In some embodiments, the zener diode is a 200 volt zener diode that provides +200 volts to the anode 132. In some embodiments of the invention, alternative voltage levels can be applied to the anode 132 if the voltage is sufficient to repel the positive ions generated.

Alternative ion trap power supply circuits and circuit topologies can be implemented in alternative embodiments of the invention in which current flow from the collector is provided to a power supply to generate the desired DC bus voltage (e.g., +200 volts) that is provide to the anode of the system to create the ion trap.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A traveling-wave tube system, comprising:

an electron gun comprising a cathode and an anode for generating a beam of electrons;

a power supply for applying an electric potential between the cathode and the anode;

a slow-wave structure having a passage through which the beam of electrons passes;

a collector for collecting electrons from the beam of electrons having a collector electrode; and an ion trap power supply circuit electrically coupled to the collector electrode to generate a DC voltage from current flowing through the ion trap power supply circuit and for applying the DC voltage to the anode to repel positive ions generated.

2. The system of claim 1, wherein current flows through the ion trap power supply circuit when the electron gun is generating the beam of electrons.

3. The system of claim 1, wherein the anode is located between the electron gun cathode and an opening to the slow-wave structure passage.

4. The system of claim 1, wherein the anode prevents positive ions from traveling to the cathode.

5. A traveling-wave tube system, comprising:

an electron gun comprising a cathode and an anode for generating a beam of electrons;

a power supply for applying an electric potential between the cathode and the anode;

a slow-wave structure having a passage through which the beam of electrons passes;

a collector for collecting electrons from the beam of electrons having a collector electrode; and a means for generating a DC voltage from current flowing from the collector electrode and for applying the DC voltage to the anode to prevent ions generated from traveling to the cathode.

6. A method for protecting a cathode of a traveling-wave tube system, comprising:

applying an electric potential between a cathode and an anode to generate a beam of electrons;

collecting electrons from the beam of electrons with a collector electrode after passing through a passage of a slow-wave structure generating a flow of current;

directing the flow of current from the collector electrode through an ion trap power supply circuit to generate a DC voltage; and applying the DC voltage to the anode to repel positive ions generated.

7. A traveling-wave tube system, comprising:

an electron gun for generating a beam of electrons;

an ion trap comprising an anode;

a collector for collecting electrons from the beam of electrons having a collector electrode; and an ion trap power supply circuit electrically coupled to the collector electrode to generate a DC voltage and for applying the DC voltage to the anode to repel positive ions generated.

8. The system of claim 7 comprising a power supply for applying an electric potential between a cathode and the anode to generate the beam of electrons.

9. The system of claim 7 comprising a slow-wave structure having a passage located between the electron gun and the collector through which the beam of electrons passes.

10. The system of claim 7, wherein current flows from the collector and through the ion trap power supply circuit to generate the DC voltage.

11. The system of claim 7, wherein the ion trap anode in combination with the cathode generates the beam of electrons.

* * * * *

UNITED STATES PATENT AND TRADEMARK OFFICE

CERTIFICATE OF CORRECTION

PATENT NO. : 7,579,778 B2
APPLICATION NO. : 11/484872
DATED : August 25, 2009
INVENTOR(S) : Vaszari et al.

It is certified that error appears in the above-identified patent and that said Letters Patent is hereby corrected as shown below:

In claim 1, at column 6, line 33, delete "positive ions generated." and replace it with --positive ions generated in the slow-wave structure by interaction of the beam of electrons with gas molecules in the slow-wave structure.--

In claim 4, at column 6, line 41, delete "positive ions" and replace it with --the positive ions--

In claim 5, at column 6, lines 53-54, delete "generated from traveling to the cathode" and replace it with --generated in the slow-wave structure by interaction of the beam of electrons with gas molecules in the slow-wave structure from traveling to the cathode.--

In claim 6, at column 6, line 67, delete "generated." and replace it with --generated in the slow-wave structure by interaction of the beam of electrons with gas molecules in the slow-wave structure.--

In claim 7, at column 7, line 9, delete "ions generated." and replace it with --ions generated in the slow-wave structure by interaction of beam of electrons with gas molecules in the slow-wave structure.--

Signed and Sealed this

Third Day of November, 2009

David J. Kappos

David J. Kappos
*Director of the United States Patent and Trademark Office*